US010944157B2

(12) United States Patent
Chen

(10) Patent No.: US 10,944,157 B2
(45) Date of Patent: Mar. 9, 2021

(54) MULTI-ARM SPIRAL ANTENNA FOR A WIRELESS DEVICE

(71) Applicant: BOSE CORPORATION, Framingham, MA (US)

(72) Inventor: Louis Chen, Bolton, MA (US)

(73) Assignee: BOSE CORPORATION, Framingham, MA (US)

( * ) Notice: Subject to any disclaimer, the term of this patent is extended or adjusted under 35 U.S.C. 154(b) by 12 days.

(21) Appl. No.: 16/389,240

(22) Filed: Apr. 19, 2019

(65) Prior Publication Data

US 2020/0335855 A1 Oct. 22, 2020

(51) Int. Cl.

| | |
|---|---|
| ***H01Q 1/12*** | (2006.01) |
| ***H01Q 1/27*** | (2006.01) |
| ***H01Q 1/36*** | (2006.01) |
| ***H01Q 1/48*** | (2006.01) |
| ***H01Q 7/00*** | (2006.01) |
| ***H04R 1/10*** | (2006.01) |

(52) U.S. Cl.

CPC ..... *H01Q 1/273* (2013.01); *H01Q 1/36* (2013.01); *H01Q 1/48* (2013.01); *H01Q 7/00* (2013.01); *H04R 1/1041* (2013.01); *H04R 1/1008* (2013.01); *H04R 1/1016* (2013.01); *H04R 2420/07* (2013.01)

(58) Field of Classification Search

None

See application file for complete search history.

(56) References Cited

U.S. PATENT DOCUMENTS

| | | | | |
|---|---|---|---|---|
| 4,366,483 | A | 12/1982 | Hagedon et al. | |
| 5,220,340 | A * | 6/1993 | Shafai | H01Q 1/36 343/895 |
| 6,646,621 | B1 | 11/2003 | Phelan et al. | |
| 6,750,828 | B1 | 6/2004 | Wixforth et al. | |
| 7,075,500 | B2 | 7/2006 | Carbonari | |
| 7,652,628 | B2 * | 1/2010 | Zweers | H01Q 1/243 343/702 |
| 8,797,230 | B2 * | 8/2014 | Leisten | H01Q 1/38 343/700 MS |
| 9,065,176 | B2 | 6/2015 | Wang | |
| 2004/0108966 | A1 | 6/2004 | McKivergan et al. | |
| 2005/0266875 | A1 | 12/2005 | Yegin et al. | |

(Continued)

FOREIGN PATENT DOCUMENTS

EP 1833116 A2 9/2007

OTHER PUBLICATIONS

McLean, James S., "A Re-Examination of the Fundamental Limits on the Radiation Q of Electrically Small Antennas", IEEE Transactions on Antennas and Propagation, vol. 44, No. 5, pp. 672-676 (May 1996).

(Continued)

*Primary Examiner* — Anh Q Tran

(74) *Attorney, Agent, or Firm* — Lando & Anastasi, LLP

(57) ABSTRACT

According to examples of the disclosure, a wearable audio device is provided. The device includes a ground plane, an enclosure configured to enclose the ground plane, and configured to be coupled to an ear of a user, and an elliptically polarized spiral monopole antenna configured to be coupled to the ground plane. The antenna includes a ring and a plurality of arms, each arm of the plurality of arms being configured to be coupled between the ring and the ground plane.

20 Claims, 8 Drawing Sheets

(56) References Cited

U.S. PATENT DOCUMENTS

| | | | | |
|---|---|---|---|---|
| 2014/0266975 | A1* | 9/2014 | Grbic | H01Q 11/083 343/895 |
| 2018/0077484 | A1* | 3/2018 | Yeung | H01Q 1/48 |
| 2018/0166776 | A1* | 6/2018 | Ziegler | H01Q 1/50 |

OTHER PUBLICATIONS

Best, Steven R., "The Radiation Properties of Electrically Small Folded Spherical Helix Antennas", IEEE Transactions on Antennas and Propagation, vol. 52, No. 4, pp. 953-960 (Apr. 2004).

Best, Steven R., "Low Q Electrically Small Linear and Elliptical Polarized Spherical Dipole Antennas", IEEE Transactions on Antennas and Propagation, vol. 53, No. 3, pp. 1047-1053 (Mar. 2005).

Extended European Search Report of European Patent Application No. 20165519.8 dated Aug. 28, 2020.

* cited by examiner

MULTI-ARM SPIRAL ANTENNA FOR A WIRELESS DEVICE

BACKGROUND

1. Field of the Disclosure

At least one example in accordance with the present disclosure relates generally to wireless devices, including wireless headphones.

2. Discussion of Related Art

Wireless headphones may include one or more components to enable wireless communication with an audio source. For example, wireless headphones may include antennas configured to send and receive signals encoding audio information to and from an audio source. In the context of certain wireless in-ear headphones, a form factor of the antenna may be restricted by a need for a headphone to fit partially within a user's ear canal.

SUMMARY

According to one aspect, a wearable audio device is provided including a ground plane, an elliptically polarized spiral monopole antenna configured to be coupled to the ground plane, the antenna comprising a ring, and a plurality of arms, each arm of the plurality of arms being configured to be coupled between the ring and the ground plane, and an enclosure configured to enclose the ground plane, and configured to be coupled to an ear of a user.

In one example, a radius of the ground plane is approximately equal to a radius of the elliptically polarized monopole antenna. In at least one example, the elliptically polarized monopole antenna is configured to transmit and/or receive a vertically polarized component of electromagnetic radiation and a horizontally polarized component of the electromagnetic radiation. In some examples, one or more arms of the plurality of arms is configured in an Archimedean spiral arrangement.

In some examples, the arms of the plurality of arms are configured to be evenly spaced around a circumference of the ring. In at least one example, the plurality of arms comprises four arms. In some examples, the device includes a plurality of conducting ports, wherein each arm is configured to be coupled to the ground plane via a respective conducting port of the plurality of conducting ports. In an example, the plurality of arms comprises three arms. In one example, each arm is configured to be coupled directly to the ground plane. In at least one example, the elliptically polarized monopole antenna is configured to be formed on a surface of the enclosure.

According to aspects of the disclosure, an antenna is provided including a ring, and a plurality of arms, each arm of the plurality of arms having a first connection coupled to the ring, and a second connection configured to be coupled to a ground plane, the plurality of arms being arranged such that the antenna is an elliptically polarized spiral monopole antenna, wherein the antenna is configured to be formed on a surface of an enclosure of a wearable audio device, the enclosure being configured to be coupled to an ear of a user.

In an example, a radius of the antenna is approximately equal to a radius of the ground plane. In one example, the antenna is configured to transmit and/or receive electromagnetic radiation from a device, and wherein the antenna is configured to transmit and/or receive a vertically polarized component of electromagnetic radiation and a horizontally polarized component of electromagnetic radiation. In at least one example, the plurality of arms is configured in an Archimedean spiral arrangement.

In one example, wherein the arms of the plurality of arms are configured to be evenly separated around a circumference of the ring and around a circumference of the ground plane. In an example, the plurality of arms comprises four arms. In some examples, each arm is configured to be coupled to the ground plane via a conducting port. In at least one example, the plurality of arms comprises three arms. In one example, each arm is configured to be coupled directly to the ground plane. In an example, the antenna is configured to be formed on the surface of the wearable audio device enclosure.

BRIEF DESCRIPTION OF THE DRAWINGS

Various aspects of at least one example are discussed below with reference to the accompanying figures, which are not intended to be drawn to scale. The figures are included to provide an illustration and a further understanding of the various aspects and examples, and are incorporated in and constitute a part of this specification, but are not intended as a definition of the limits of any particular example. The drawings, together with the remainder of the specification, serve to explain principles and operations of the described and claimed aspects and examples. In the figures, each identical or nearly identical component that is illustrated in various figures is represented by a like numeral. For purposes of clarity, not every component may be labeled in every figure. In the figures:

DETAILED DESCRIPTION

Figure 1:
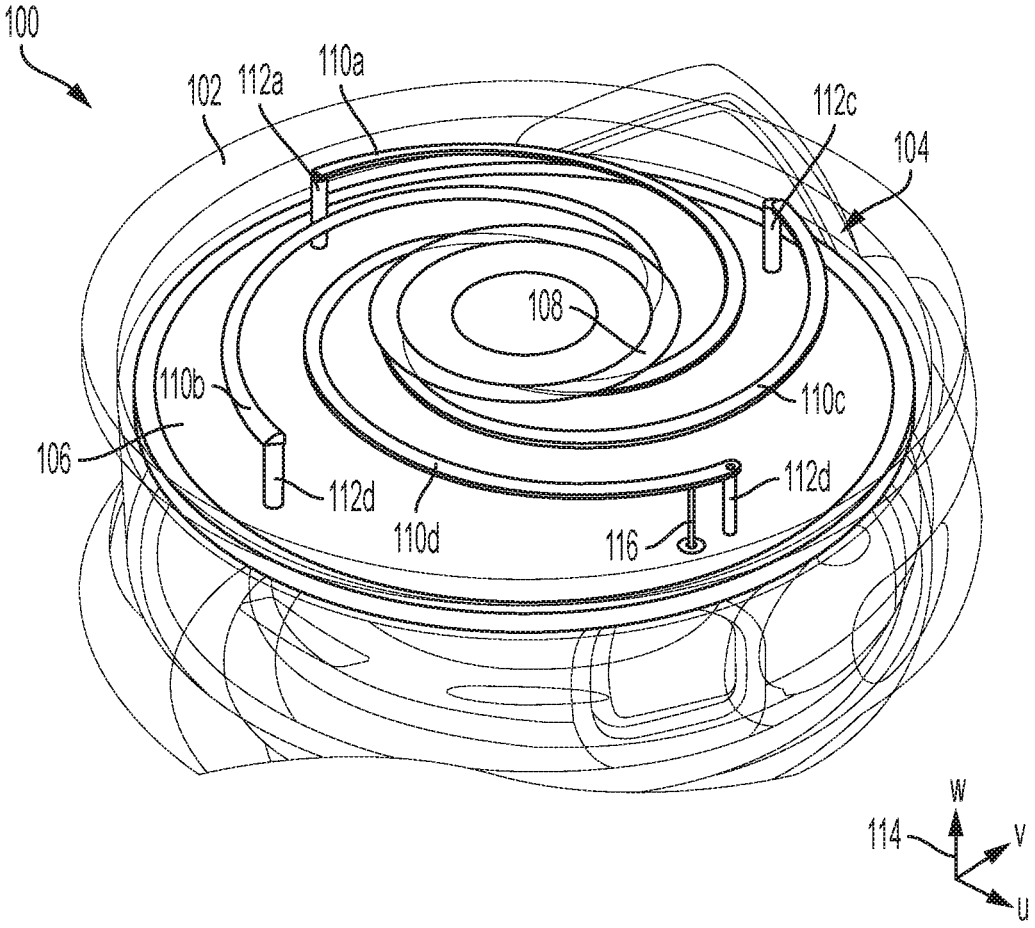
FIG. 1 illustrates a perspective view of a device according to an example.

Wireless headphone antennas may be designed with a circular or an elliptical (which may be circular or non-circular) polarization along a broadside of the antenna. In an example, an elliptically polarized monopole antenna is coupled to a small ground plane. The diameter of the antenna is approximately equal to the diameter of the ground plane. The antenna may include one or more spiral arms. These spiral arms may include one or more Archimedean spiral arms. One end of each spiral arm may be connected to a ring centered above a ground disc. A second end of the spiral arm may be connected to the ground disc either directly or via a conducting port. The ends of the spiral arms may be evenly separated around a circumference of the ring and the ground plane.

A circularly or elliptically polarized monopole antenna may be beneficial in a low-profile wearable device that does not extend from a user's ear canal or pinna significantly or at all. The antenna is configured to receive both horizontally or vertically polarized components of electromagnetic radiation propagating along a referenced observation interface, such as the surface of a human body. Furthermore, the antenna may have an advantageously low profile in part due to the monopole, rather than dipole, structure of the antenna, at least because a dipole antenna may have a volume that is approximately twice a volume of a monopole antenna. Thus, an exemplary elliptically polarized monopole antenna may be capable of transmitting and receiving both vertically polarized and horizontally polarized components of electromagnetic radiation without detrimentally impacting a profile of the antenna.

The examples discussed herein are not limited in application to the details of construction and the arrangement of components set forth in the following description or illustrated in the accompanying drawings. The methods and systems are capable of implementation in other examples and of being practiced or of being carried out in various ways. Examples of specific implementations are provided herein for illustrative purposes only and are not intended to be limiting. In particular, acts, components, elements and features discussed in connection with any one or more examples are not intended to be excluded from a similar role in any other examples.

Also, the phraseology and terminology used herein is for the purpose of description and should not be regarded as limiting. Any references to examples, components, elements or acts of the systems and methods herein referred to in the singular may also embrace examples including a plurality, and any references in plural to any example, component, element or act herein may also embrace examples including only a singularity. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items.

References to "or" may be construed as inclusive so that any terms described using "or" may indicate any of a single, more than one, and all of the described terms. In addition, in the event of inconsistent usages of terms between this document and documents incorporated herein by reference, the term usage in the incorporated features is supplementary to that of this document; for irreconcilable differences, the term usage in this document controls.

A headphone or earphone may refer to a device that typically fits around, on, in, or near an ear and that radiates acoustic energy into or towards the ear canal. Headphones and earphones are sometimes referred to as earpieces, headsets, earbuds, or sport headphones, and can be wired or wireless. Certain wireless headphones play audio to a user based on information received from an audio source. An audio source may include a computing device (for example, a laptop computer, desktop computer, tablet, smartphone, or other electronic device) configured to communicate wireless signals encoding audio information to the wireless headphones. While headphones are described in various examples within this document, the technology described in this document is also applicable to other wearable audio devices. The term "wearable audio device," as used in this document, is intended to mean a device that fits around, on, in, or near an ear (including open-ear audio devices worn on the head or shoulders of a user) and that radiates acoustic energy into or towards the ear. Wearable audio devices include but are not limited to headphones, earphones, earpieces, headsets, earbuds, sport headphones, and audio eyeglasses, and can be wired or wireless. In some examples, a wearable audio device may be an open-ear device that includes an acoustic driver to radiate acoustic energy towards the ear while leaving the ear open to its environment and surroundings.

A headphone may include an electro-acoustic transducer driver to transduce audio signals into acoustic energy. The acoustic driver may be housed in an earcup, earbud, or other housing. Some of the figures and descriptions following show a single headphone device. A headphone may be a single stand-alone unit or one of a pair of headphones (each including at least one acoustic driver), one for each ear. A headphone may be connected mechanically and/or electrically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other components, such as microphones, accelerometers, gyroscopes, infrared sensors, compasses, and so forth. A headphone may also be an open-ear device that includes an electro-acoustic transducer to radiate acoustic energy towards the ear canal while leaving the ear open to its environment and surroundings.

Figure 3:
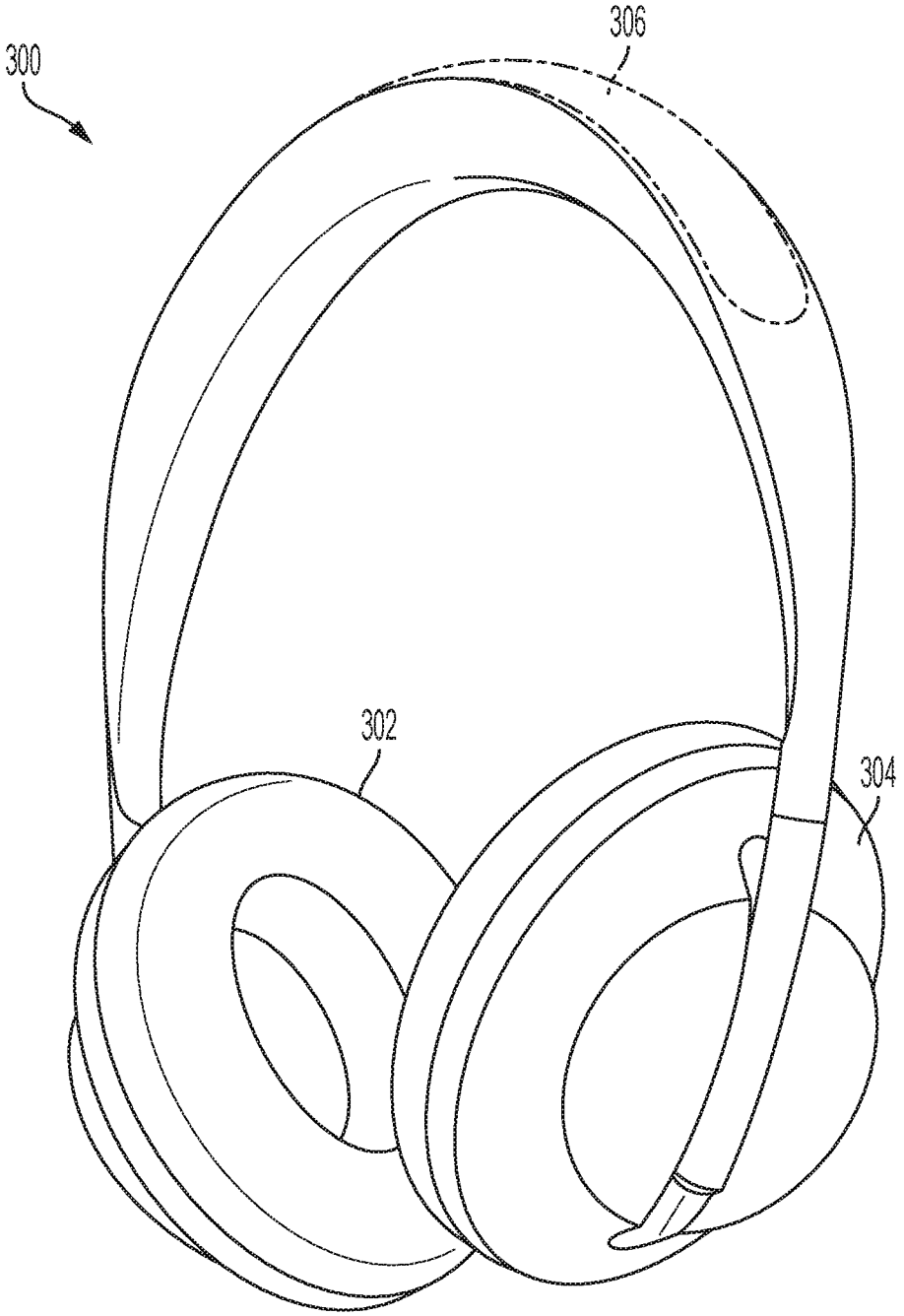
FIG. 3 illustrates a perspective view of headphones according to an example.

Exemplary headphones will be described. FIG. 3 illustrates a perspective view of headphones 300 according to an example. The headphones 300 include a first housing 302, a second housing 304, and a connector 306. In one example, the first housing 302 may be configured to be placed over one of a user's ears, and the second housing 304 may be configured to be placed over another of the user's ears. The first housing 302 and the second housing 304 may each respectively include an acoustic driver configured to transmit acoustic energy to the user. The connector 306 may provide an electrical and/or mechanical connection between the first housing 302 and the second housing 304 and facilitate coupling of the headphones 300 to the user's ears and/or head.

Figure 4:
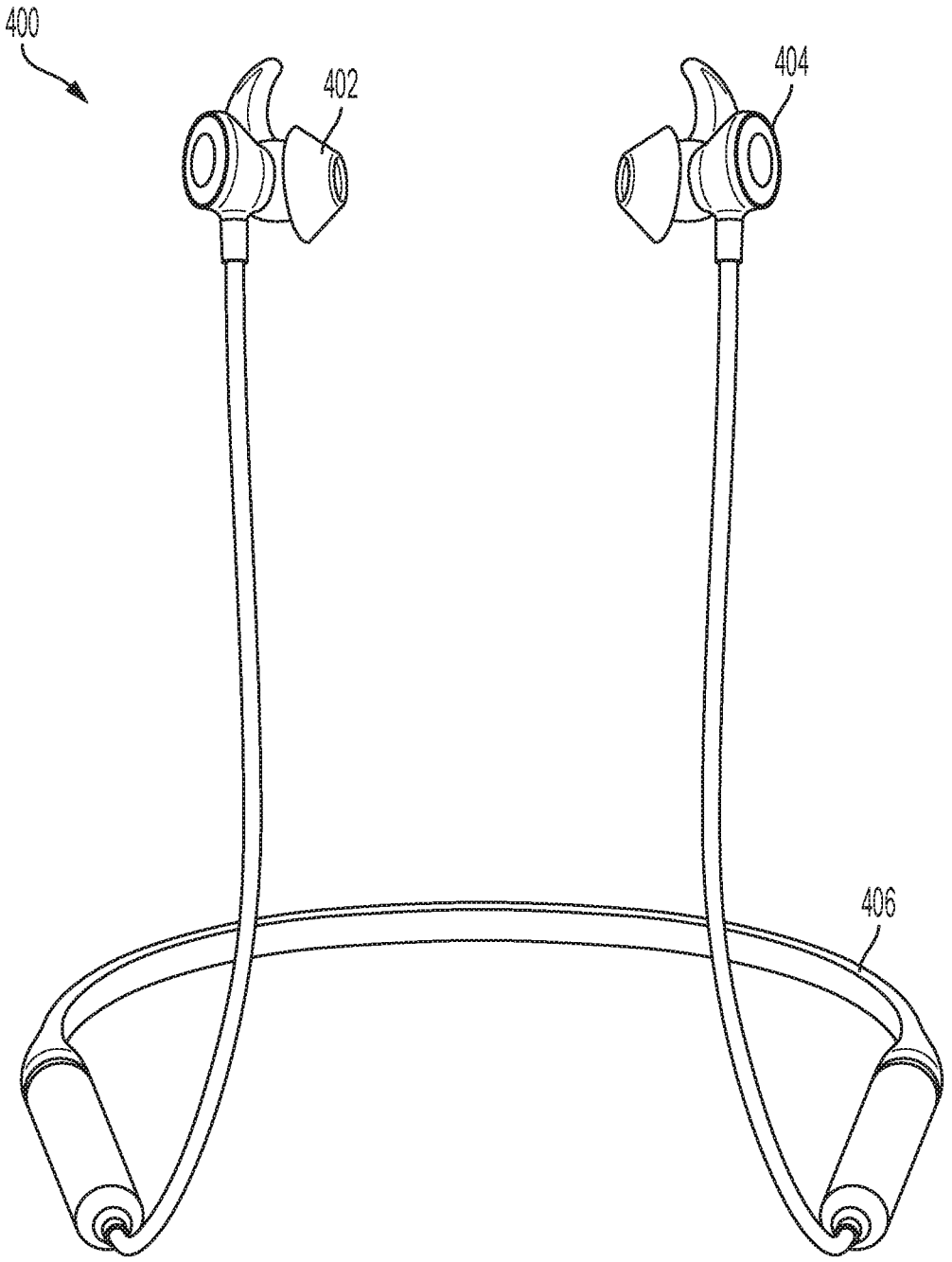
FIG. 4 illustrates a perspective view of headphones according to another example.

FIG. 4 illustrates a perspective view of headphones 400 according to another example. The headphones 400 include a first housing 402, a second housing 404, and a connector 406. In one example, the first housing 402 may be configured to be inserted into one of a user's ear canals or pinne, and the second housing 304 may be configured to be inserted into another of the user's ear canals or pinne. The first housing 402 and the second housing 404 may each respectively include an acoustic driver configured to provide acoustic energy to the user. The connector 406 may provide an electrical and/or mechanical connection between the first housing 402 and the second housing 404.

Figure 5A:
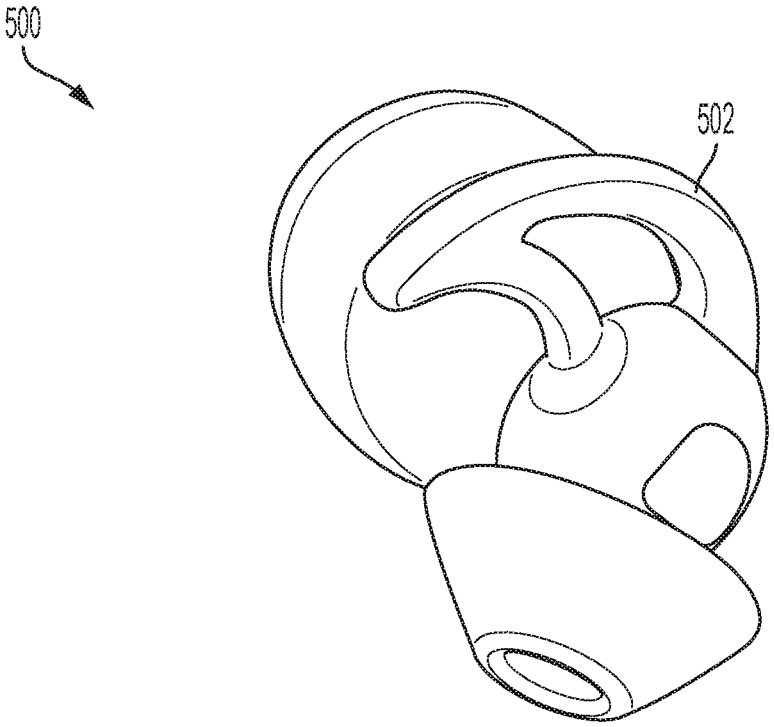
FIG. 5A illustrates a first perspective view of a headphone according to an example.
Figure 5B:
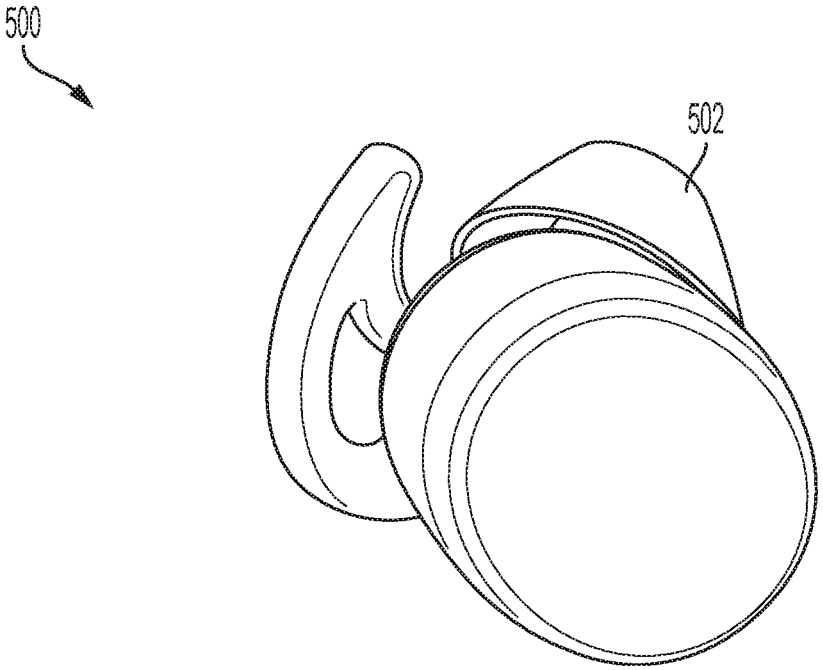
FIG. 5B illustrates a second perspective view of the headphone according to an example.

FIG. 5A illustrates a perspective view of a headphone 500 according to another example. FIG. 5B illustrates another perspective view of the headphone 500 according to an example. The headphone 500 includes a housing 502. In one example, the housing 502 may be configured to be inserted into one of a user's ear canals or pinne. The housing 502 may include an acoustic driver configured to provide acoustic energy to the user. The headphone 500 may be implemented in conjunction with another, similar, headphone configured to be inserted into another of the user's ear canals or pinne. In some examples, the headphone 500 and the similar headphone may communicate wirelessly with one another.

Wireless headphones may include one or more antennas. Antennas can convert electromagnetic waves propagating through space into electrical currents. Certain antenna properties may be affected by a form factor of the antenna. For example, the form factor of an antenna may dictate radiation behavior (for example, a radiation pattern), polarization, efficiency, and configuration options.

A form factor of the antenna may also dictate how the antenna is implemented. As used herein, a "profile" refers to an extent to which an in-ear headphone extends out of the ear canal or pinna. A low-profile antenna or headphone may refer to an antenna or headphone that does not extend significantly, or at all, out of a user's ear canal or pinna when in use. A high-profile antenna or headphone, in contrast, may refer to an antenna or headphone that extends significantly from the ear canal or pinna. Some users may prefer low-profile antennas over high-profile antennas, because such users may consider low-profile antennas to be more comfortable or aesthetic, and because high-profile antennas may have a less mechanically stable mounting.

Figure 6B:
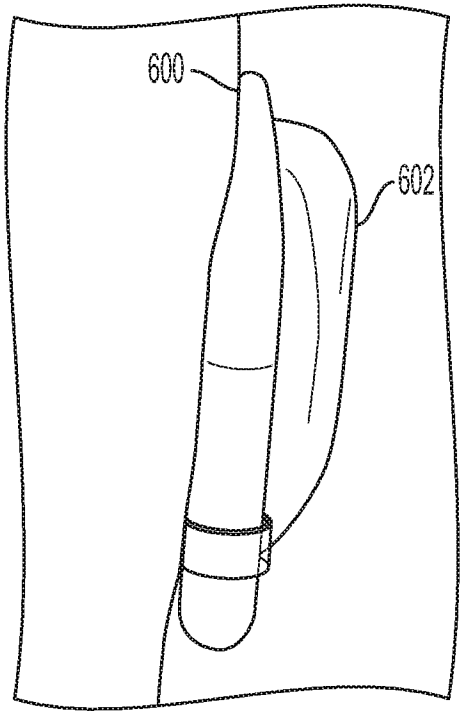
FIG. 6B illustrates a back view of the wearable audio device according to an example.
Figure 6A:
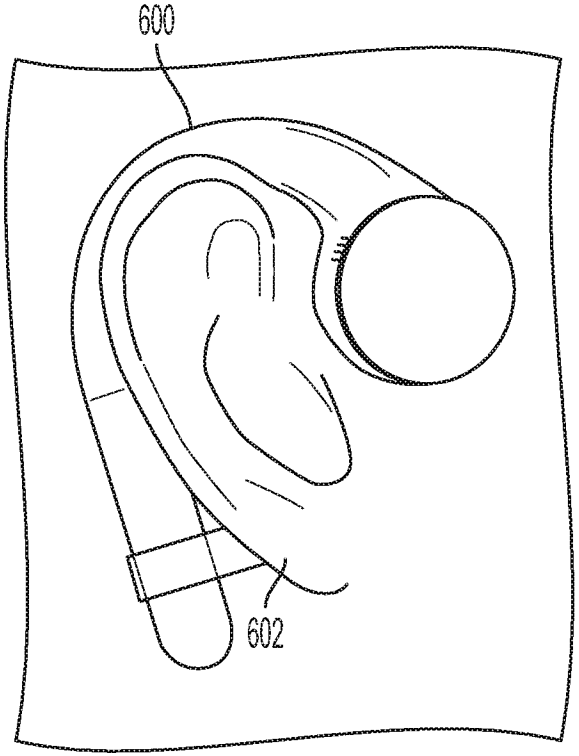
FIG. 6A illustrates a side view of a wearable audio device according to an example.

For example, FIG. 6A illustrates a side view of a wearable audio device 600 coupled to an ear 602 of a user. FIG. 6B illustrated a back view of the wearable audio device 600 coupled to the ear 602 of the user. As illustrated by FIG. 6B, the wearable audio device 600 does not extend far enough out of the ear 602 of the user to be visible behind the ear 602. The wearable audio device 600 may thus be considered to be a low-profile wearable audio device, at least because the wearable audio 600 device does not extend significantly out of the ear 602.

Figure 7B:
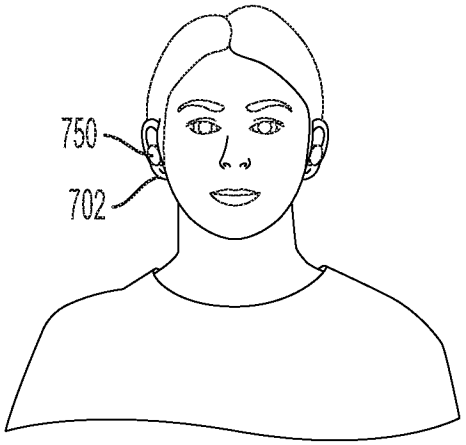
FIG. 7B illustrates a frontal view of a wearable audio device according to an example.
Figure 7A:
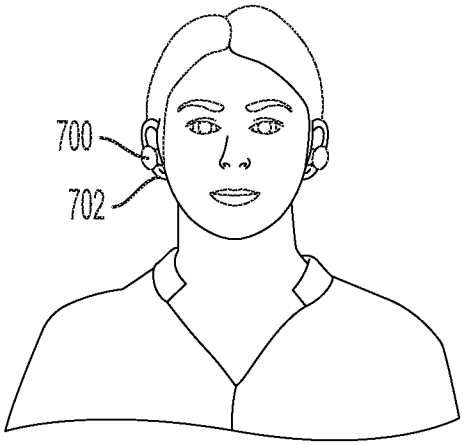
FIG. 7A illustrates a frontal view of a wearable audio device according to an example.

In another example, FIG. 7A illustrates a frontal view of a wearable audio device 700 coupled to an ear 702 of a user. FIG. 7B illustrates a frontal view of a wearable audio device 750 coupled to the ear 702 of the user. As illustrated by FIGS. 7A and 7B, the wearable audio device 700 extends farther out from the ear 702 of the user than the wearable audio device 750. The wearable audio device 700 may thus be considered to have a higher profile than the wearable audio device 750.

Elliptically polarized antennas capable of receiving both horizontally and vertically polarized components of electromagnetic radiation may be advantageous for headphones, including low profile headphones. Headphones described herein are capable of receiving both vertically polarized and horizontally polarized components of electromagnetic radiation while maintaining a low profile. Although other implementations are contemplated, some examples include an elliptically polarized monopole antenna. A ground plane to which the monopole antenna is coupled may have a diameter that is roughly equivalent to a diameter of the antenna. Thus, examples of headphones are provided in which the headphones include antennas capable of receiving both vertically polarized and horizontally polarized components of electromagnetic radiation, and mitigate disadvantages associated with vertically polarized antennas' high-profile form factors.

FIG. 1 illustrates a perspective view of a device 100 according to an example. The device 100 may be implemented in connection with a wearable audio device, such as a wireless in-ear headphone configured to be inserted into, or coupled proximate to, a human ear canal. For example, the device 100 may be implemented in connection with (for example, housed within) one of the first housing 402, the second housing 404, and the housing 502. The device 100 includes a headphone enclosure 102, an antenna 104, and a ground disc 106, or "ground plane." The headphone enclosure 102 is illustrated as partially transparent for purposes of illustration of components of the device 100, including the antenna 104 and the ground disc 106.

The headphone enclosure 102 is configured to enclose components of the device 100 including, for example, the antenna 104 and the ground disc 106. The headphone enclosure 102 may include a material or materials that enable the antenna 104 to be formed on a surface of the headphone enclosure 102, such as laser direct structuring (LDS) materials. For example, the headphone enclosure 102 may be formed of a non-conductive material impregnated with a conductive material. The antenna 104 may be formed using antenna formation techniques including, for example, LDS or other antenna formation techniques.

As discussed above, a form factor of the headphone enclosure 102 may be an important feature of the device 100 for users. For example, users may dislike headphones having profiles that extend far outside of the ear canal or the pinna when worn. Such high-profile headphones may be disadvantageously bulky or unaesthetic to users, and may not have a mechanically stable mounting. In some examples, the device 100 may be a low-profile headphone, constructed such that the headphone enclosure 102 does not extend outside of the ear canal or pinna significantly or at all when the device 100, or a device within which the device 100 may be housed, is inserted into a user's ear canal.

The antenna 104 includes a ring 108, arms 110*a*-110*d*, connectors 112*a*-112*d*, and an excitation port 116. Each of the arms 110*a*-110*d* is connected to the ring 108 at a respective first connection, and is connected to a respective connector of the connectors 112*a*-112*d* at a respective second connection. Each of the connectors 112*a*-112*d* is connected to a respective arm of the arms 110*a*-110*d* at a first end, and is connected to the ground disc 106 at a respective second end.

The excitation port 116 may not be connected to the ground disc 106, and may be referenced to ground. In a first example, the excitation port 116 is physically close to the connector 112*d* such that the connector 112*d* acts as a shunt inductance for impedance matching. In a second example, the excitation port 116 may be removed, and the connector 112*d* may instead act as an excitation port. In the second example, the connector 112*d* may be coupled to ground, but may be referenced to the ground disc 106.

In an example, the antenna 104 is elliptically polarized. For purposes of the following example, properties of the device 100 are discussed with respect to the u, v, and w axes indicated by the axis legend 114. In one example, the antenna 104 has an axial ratio of approximately 3 dB, such that a radiation pattern is predominantly vertically polarized.

In one example, the arms 110*a*-110*d* include four Archimedean spirals evenly spaced about a circumference of the ring 108 and about a circumference of the ground disc 106. The arms 110*a*-110*d* are evenly spaced about a circumference of the ring 108 and the ground disc 106 inasmuch as the arms 110*a*-110*d* are symmetrical about any line evenly bisecting the ring 108, and evenly bisecting the ground disc 106.

In one example, each of the arms 110*a*-110*d* includes a respective first connection configured to be coupled to the ring 108, and a respective second connection configured to be coupled to the ground disc 106. The first connections of the arms 110*a*-110*d* may be evenly spaced in 90-degree increments about a circumference of the ring 108, and the second connections of the arms 110*a*-110*d* may be evenly spaced in 90-degree increments about a circumference of the ground disc 106.

For example, a first connection of the arm 110*a* may be coupled to a point on the ring 108 that is 90 degrees, measured in a counterclockwise arc from a center of the ring 108, from a point on the ring 108 at which a first connection of the arm 110*c* is coupled. Similarly, a first connection of the arm 110*b* may be coupled to a point on the ring 108 that is 90 degrees, measured in a counterclockwise arc from the center of the ring 108, from the point on the ring 108 at which the first connection of the arm 110*a* is coupled.

The second connection of the arm 110*a* may similarly be coupled (either directly, or via the connector 112*a*) to a point on the ground disc 106 that is 90 degrees, measured in a counterclockwise arc from a center of the ground disc 106, from a point on the ground disc 106 at which a second connection of the arm 110*c* is coupled (either directly, or via the connector 112*c*). Similarly, a second connection of the arm 110*b* may be coupled to a point on the ground disc 106 that is 90 degrees, measured in a counterclockwise arc from the center of the ground disc 106, from the point on the ground disc 106 at which the second connection of the arm 110*a* is coupled.

A radius of the ground disc 106 may differ from a radius of the ring 108 (i.e., a distance in the u-v plane from the center of the ring 108 to any one of the first connections of the arms 110*a*-110*d*). Thus, while the first connection of the arm 110*a* may be separated by 90 degrees from the first connection of the arm 110*b*, and the second connection of the arm 110*a* may be separated by 90 degrees from the second connection of the arm 110*b*, an arc length between the first connection of the arm 110*a* and the first connection of the arm 110*b* in the u-v plane may be different than (for example, shorter than) an arc length between the second connection of the arm 110*a* and the second connection of the arm 110*b* in the u-v plane.

In other examples, arms may be added or removed. For example, increasing the number of arms may advantageously increase a radiation resistance of the antenna 104 as well as reducing a quality factor. Furthermore, although the ring 108 is illustrated as being circular, the ring 108 may take another form, such as by being rectangularly shaped.

Although the arms 110*a*-110*d* are arranged in a roughly spiral arrangement in the u-v plane, the arms 110*a*-110*d* may alternately be arranged in a square arrangement, a pentagonal arrangement, a hexagonal arrangement, or other arrangements in the u-v plane. Furthermore, the arms 110*a*-110*d* may have a geometry other than the illustrated Archimedean spiral geometry in some examples, and may be spaced regularly or irregularly around the circumference of the ring 108.

The connectors 112*a*-112*d* may include any conductive connectors, such as vertical conducting ports, pogo pins, conducting trace patterns etched on a surface of the enclosure 102, and so forth. In some examples, all of the connectors 112*a*-112*d* are connected to the ground disc 106, with an excitation port (for example, the excitation port 116) implemented physically close to one of the connectors 112*a*-112*d* to improve impedance matching. In other examples, one of the connectors 112*a*-112*d* may be disconnected from the ground disc 106 and may function as an excitation port. For example, the excitation port may be implemented to provide impedance matching as necessary or desired.

As discussed above, examples of in-ear headphones may be configured to communicate with electrical devices. For example, the devices may transmit electromagnetic radiation to, or receive electromagnetic radiation from, the in-ear headphones' antennas, such as the antenna 104. In some examples, the antenna 104 may have a radiation pattern that advantageously reduces the transmit power of the antenna 104 relative to certain conventional linearly polarized antennas. For example, the antenna 104 may have a low radiating power in a direction facing into the human body. Thus, unlike certain conventional linearly polarized antennas, which couple a significant amount of radiation into the human body, examples of the antenna 104 may minimize such disadvantageous coupling and thereby minimize a total amount of radiation absorbed by the human body.

Thus, at least one example provides an elliptically polarized monopole antenna coupled to a small ground disc. More particularly, a diameter of the ground disc 106 may be approximately equal to a diameter of the antenna 104 to enable the antenna 104 to transmit and receive both horizontally polarized and vertically polarized components of electromagnetic radiation. Although the antenna 104 is able to transmit and receive a vertically polarized component electromagnetic radiation, a profile of the device 100 is sufficiently low that the device 100 does not extend significantly or at all from the ear canal or pinna when in use. Thus, the device 100 may be capable of transmitting and receiving both vertically polarized and horizontally polarized components of electromagnetic radiation without compromising a form factor of the device 100.

Figure 2:
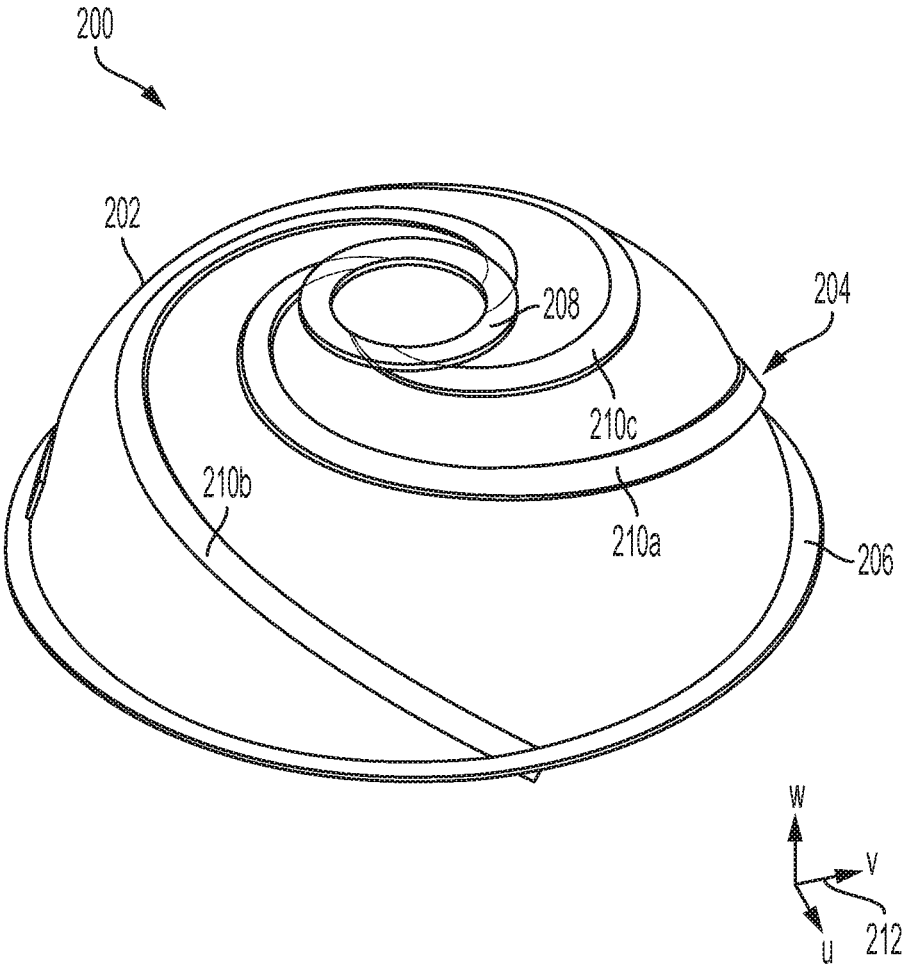
FIG. 2 illustrates a perspective view of a device according to another example.

FIG. 2 illustrates a perspective view of a device 200 according to another example. The device 200 may be implemented in connection with a wearable audio device, such as a wireless in-ear headphone configured to be inserted into, or proximate to, a human ear canal. For example, the device 200 may be implemented in connection with (for example, housed within) one of the first housing 402, the second housing 404, and the housing 502. The device 200 includes a headphone enclosure 202, an antenna 204, and a ground disc 206, or ground plane.

The headphone enclosure 202 is configured to enclose or be otherwise coupled to components of the device 200 including, for example, the antenna 204 and the ground disc 206. The headphone enclosure 202 may have a form factor approximated by, for example, a $5^{th}$-order polynomial. The headphone enclosure 202 may include a material or materials that enable the antenna 204 to be formed on a surface of the headphone enclosure 202, such as LDS materials. For example, the headphone enclosure 202 may be formed of a non-conductive material impregnated with a conductive material. The antenna 204 may be formed using antenna fabrication techniques including, for example, LDS or other techniques.

As discussed above, a form factor of the headphone enclosure 202 may be an important feature of the device 200 for users. Similar to the device 100, in some examples, the device 200 may be a low-profile headphone, constructed such that the headphone enclosure 202, or a device within which the device 200 may be housed, does not extend outside of the ear canal or pinna significantly or at all when in use.

The antenna 204 includes a ring 208 and arms 210*a*-210*c*. Each of the arms 210*a*-210*c* is connected to the ring 208 at a respective first connection and is connected to the ground disc 206 at a respective second connection. In an example, the antenna 204 is elliptically polarized. For purposes of the following example, properties of the device 200 are discussed with respect to the u, v, and w axes indicated by the axis legend 212.

The antenna 204 may be elliptically shaped, having a major axis along the u axis and a minor axis along the v axis. In some examples, an eccentricity ratio of the antenna 204 is approximately 1. A shape and size of the ground disc 206 may be similar to, or slightly greater than, a shape and size of a w-axis projection of an envelope of the antenna 204.

In one example, the arms 210*a*-210*c* include three Archimedean spirals evenly spaced around a circumference of the ring 208 and about a circumference of the ground disc 206. The arms 210*a*-210*c* may be evenly spaced about a circumference of the ring 208 and the ground disc 206 inasmuch as the arms 210*a*-210*c* are symmetrical about any line evenly bisecting the ring 208, and evenly bisecting the ground disc 206.

As discussed above, each of the arms 210*a*-210*c* includes a respective first connection configured to be coupled to the ring 208, and a respective second connection configured to be coupled to the ground disc 206. The first connections of the arms 210*a*-210*c* may be evenly spaced in 120-degree increments about a circumference of the ring 208, and the second connections of the arms 210*a*-210*c* may be evenly spaced in 120-degree increments about a circumference of the ground disc 206.

For example, a first connection of the arm 210*a* may be coupled to a point on the ring 208 that is 120 degrees, measured in a counterclockwise arc from a center of the ring 208, from a point on the ring 208 at which a first connection of the arm 210*c* is coupled. Similarly, a first connection of the arm 210*b* may be coupled to a point on the ring 208 that is 120 degrees, measured in a counterclockwise arc from the center of the ring 208, from the point on the ring 208 at which the first connection of the arm 210*a* is coupled.

The second connection of the arm 210*a* may similarly be coupled to a point on the ground disc 206 that is 120 degrees, measured in a counterclockwise arc from a center of the ground disc 206, from a point on the ground disc 206 at which a second connection of the arm 210*c* is coupled. Similarly, a second connection of the arm 210*b* may be coupled to a point on the ground disc 206 that is 120 degrees, measured in a counterclockwise arc from the center of the ground disc 206, from the point on the ground disc 206 at which the second connection of the arm 210*a* is coupled.

In some examples, the antenna 204 may include an excitation port referenced to ground. In a first example, the excitation port may be physically close to at least one of the connectors 210*a*-210*c* such that the at least one connector acts as a shunt inductance for impedance matching. In a second example, no separate excitation port may be implemented, and one of the connectors 210*a*-210*c* may instead act as an excitation port. In the second example, the connector acting as an excitation port may be coupled to ground, rather than the ground disc 206, but may be referenced to the ground disc 206.

A radius of the ground disc 206 may differ from a radius of the ring 208 (i.e., a distance in the u-v plane from the center of the ring 208 to any one of the first connections of the arms 210*a*-210*c*). Thus, while the first connection of the arm 210*a* may be separated by 120 degrees from the first connection of the arm 210*b*, and the second connection of the arm 210*a* may be separated by 120 degrees from the second connection of the arm 210*b*, an arc length between the first connection of the arm 210*a* and the first connection of the arm 210*b* in the u-v plane may be different than (for example, shorter than) an arc length between the second connection of the arm 210*a* and the second connection of the arm 210*b* in the u-v plane.

In other examples, arms may be added or removed. For example, increasing a number of arms may advantageously increase a radiation resistance of the antenna 204 as well as reducing the quality factor.

Although the arms 210*a*-210*c* may be arranged in a roughly elliptical arrangement in the u-v plane, the arms 210*a*-210*c* may be arranged in a square arrangement, a pentagonal arrangement, a hexagonal arrangement, or other arrangements in the u-v plane. Furthermore, the arms 210*a*-210*c* may have a geometry other than the illustrated Archimedean spiral geometry in other examples, and may be separated regularly or irregularly around the circumference of the ring 208.

Thus, similar to examples of the device 100, examples of the device 200 may provide an elliptically polarized monopole antenna coupled to a small ground disc. A diameter of the ground disc 206 may be approximately equal to a diameter of the antenna 204 to enable the antenna 204 to receive both horizontally polarized and vertically polarized components of electromagnetic radiation. Although the antenna 204 is able to receive a vertically polarized component of electromagnetic radiation, a profile of the device 200 is sufficiently low that the device 200 does not extend significantly or at all from the ear canal or pinna when in use. Thus, the device 200 may be capable of receiving both horizontally polarized and vertically polarized components of electromagnetic radiation without compromising a form factor of the device 200.

Similar to the antenna 104, the antenna 204 may have a radiation pattern that advantageously reduces the antenna's 204 transmit power relative to certain conventional linearly polarized antennas. For example, the antenna 104 may have a low radiating power in a direction facing into the human body, thereby minimizing a total amount of power absorbed by a user.

Examples of antennas have been provided having certain numbers of arms, such as three or four arms, evenly spaced around a ring. In other examples, an alternate number of arms may be implemented. The arms may be evenly or unevenly spaced around a ring. In an example in which arms are evenly spaced around the ring, the arms may be separated by n degrees, where n is equal to 360 degrees divided by the number of arms. Thus, in an example in which five arms are evenly spaced around the ring, the arms would be evenly spaced every 72 degrees around the circumference of the ring. In examples in which the arms are unevenly spaced around the ring, the arms may be separated by any number of degrees around the ring. In some examples, an elliptical polarization property of an antenna may be maintained where a degree of unevenness is low, or on the order of small perturbations.

As discussed above, a radius (or major axis, if the antenna 104 is a non-circular ellipse) of the antenna 104 projected onto the u-v plane may be approximately equal to, or slightly less than, a radius of the ground disc 106 in the u-v plane. A radii ratio of the device 100 may refer to the radius of the ground disc 106 as defined above divided by the radius of the antenna 104 projected onto the u-v plane.

Similarly, a radius of the ground disc 206 may be approximately equal to, or slightly greater than, a radius of the antenna 204 projected onto the u-v plane. A radii ratio of the device 200 may refer to the radius of the ground disc 206 as defined above divided by the radius of the antenna 204.

Figure 8:
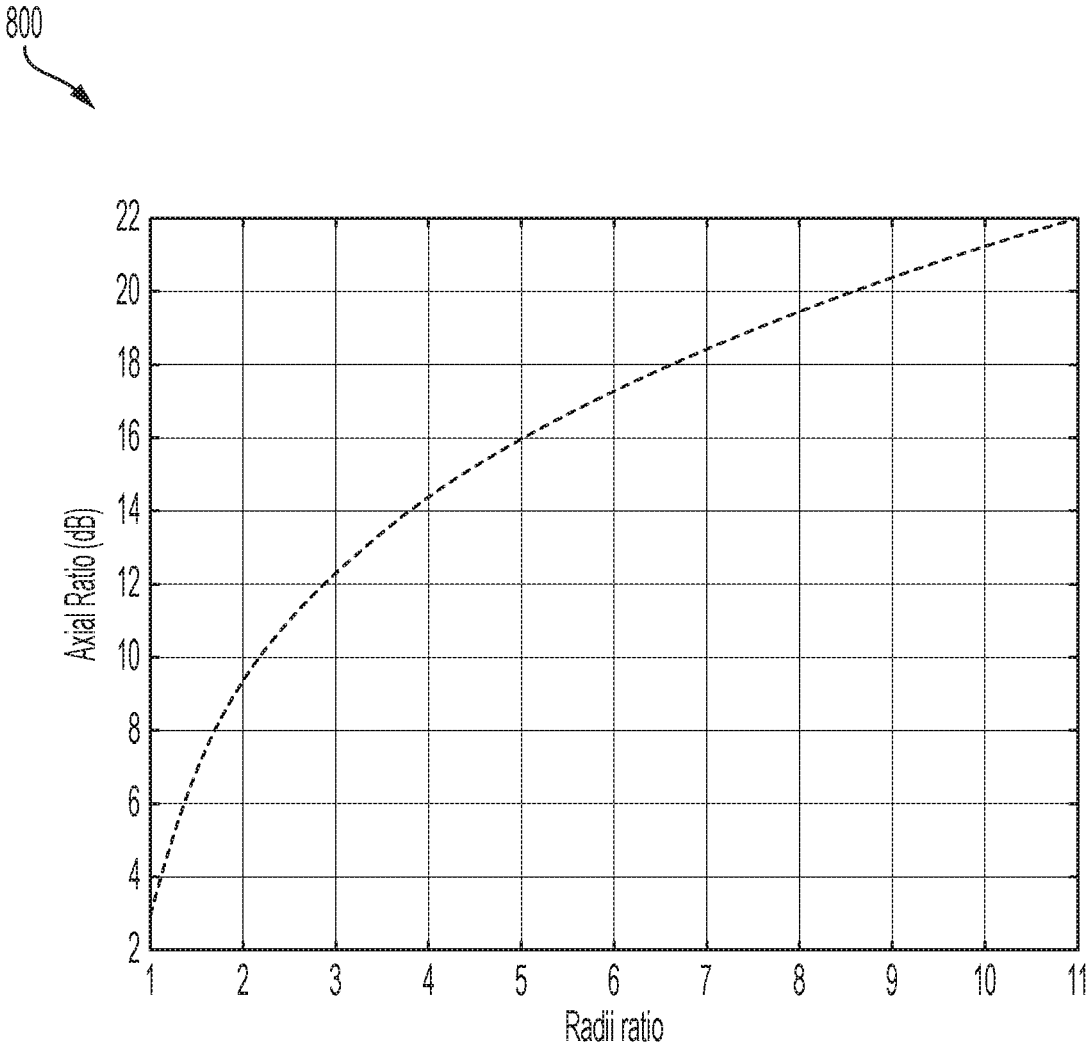
FIG. 8 illustrates a graph of a device radii ratio against a device axial ratio.

In other examples, other radii ratios may be implemented. FIG. 8 illustrates a graph 800 of a radii ratio of each of the devices 100, 200 against an axial ratio of the respective devices 100, 200. As discussed above, the radii ratio may refer to a ratio of a radius of one of the ground disc 106, 206 to a radius of one of the antenna 104, 204, respectively. The axial ratio refers to the ratio of the vertical to horizontal polarization of the devices 100, 200. Thus, the greater the radius of the ground discs 106, 206, the greater the vertical polarization of the devices 100, 200.

Although certain examples are provided as related to wireless audio devices, such as headphones, other examples may include any wireless wearable and/or hearable devices. Furthermore, examples may extend beyond audio applications. For example, certain examples may be implemented in connection with one or more communication links carrying vital signals of medical devices, such as implanted medical devices.

Having thus described several aspects of at least one example, it is to be appreciated various alterations, modifications, and improvements will readily occur to those skilled in the art. Such alterations, modifications, and improvements are intended to be part of, and within the spirit and scope of, this disclosure. Accordingly, the foregoing description and drawings are by way of example only.

What is claimed is:

1. A wearable audio device comprising:

a ground plane;

a non-circular elliptically polarized spiral monopole antenna configured to be coupled to the ground plane, the antenna comprising:

a ring; and a plurality of arms, each arm of the plurality of arms being configured to be coupled between the ring and the ground plane; and an enclosure configured to enclose the ground plane, and configured to be coupled to an ear of a user.

2. The wearable audio device of claim 1, wherein a radius of the ground plane is approximately equal to a radius of the non-circular elliptically polarized monopole antenna.

3. The wearable audio device of claim 2, wherein the non-circular elliptically polarized monopole antenna is configured to transmit and/or receive a vertically polarized component of electromagnetic radiation and a horizontally polarized component of the electromagnetic radiation.

4. The wearable audio device of claim 1, wherein one or more arms of the plurality of arms is configured in an Archimedean spiral arrangement.

5. The wearable audio device of claim 4, wherein the arms of the plurality of arms are configured to be evenly spaced around a circumference of the ring.

6. The wearable audio device of claim 1, wherein the plurality of arms comprises four arms.

7. The wearable audio device of claim 1, further comprising a plurality of conducting ports, wherein each arm is configured to be coupled to the ground plane via a respective conducting port of the plurality of conducting ports.

8. The wearable audio device of claim 1, wherein the plurality of arms comprises three arms.

9. The wearable audio device of claim 1, wherein each arm is configured to be coupled directly to the ground plane.

10. The wearable audio device of claim 1, wherein the non-circular elliptically polarized monopole antenna is configured to be formed on a surface of the enclosure.

11. An antenna comprising:

a ring; and a plurality of arms, each arm of the plurality of arms having a first connection coupled to the ring, and a second connection configured to be coupled to a ground plane, the plurality of arms being arranged such that the antenna is a non-circular elliptically polarized spiral monopole antenna, wherein the antenna is configured to be formed on a surface of an enclosure of a wearable audio device, the enclosure being configured to be coupled to an ear of a user.

12. The antenna of claim 11, wherein a radius of the antenna is approximately equal to a radius of the ground plane.

13. The antenna of claim 11, wherein the antenna is configured to transmit and/or receive electromagnetic radiation from a device, and wherein the antenna is configured to transmit and/or receive a vertically polarized component of electromagnetic radiation and a horizontally polarized component of electromagnetic radiation.

14. The antenna of claim 11, wherein the plurality of arms is configured in an Archimedean spiral arrangement.

15. The antenna of claim 11, wherein the arms of the plurality of arms are configured to be evenly separated around a circumference of the ring and around a circumference of the ground plane.

16. The antenna of claim 11, wherein the plurality of arms comprises four arms.

17. The antenna of claim 11, wherein each arm is configured to be coupled to the ground plane via a conducting port.

18. The antenna of claim 11, wherein the plurality of arms comprises three arms.

19. The antenna of claim 11, wherein each arm is configured to be coupled directly to the ground plane.

20. The antenna of claim 11, wherein the antenna is configured to be formed on the surface of the wearable audio device enclosure.

* * * * *